US005385237A

United States Patent [19]

Mathews

[11] Patent Number: 5,385,237

[45] Date of Patent: Jan. 31, 1995

[54] NEEDLEWORK THREAD ORGANIZER

[76] Inventor: Margaret R. Mathews, St. Dominic Retirement Center 2401 Holcombe Blvd., Houston, Tex. 77021

[21] Appl. No.: 832,900

[22] Filed: Feb. 10, 1992

[51] Int. Cl.[6] ..... B65D 85/00

[52] U.S. Cl. ..... 206/574; 206/227; 206/382; 206/49; 206/495; 206/805; 206/459.5

[58] Field of Search ..... 206/574, 227, 232, 380, 206/382, 383, 388, 49, 425, 459, 478, 483, 495, 805

[56] References Cited

U.S. PATENT DOCUMENTS

| | | | |
|---|---|---|---|
| 610,859 | 9/1898 | Gleason | 206/388 |
| 1,506,010 | 8/1924 | Lapin | 206/495 |
| 2,079,010 | 5/1937 | Gudebrod | 206/227 X |
| 2,646,196 | 7/1953 | York | 206/388 X |
| 2,839,185 | 6/1958 | Isaacs | 206/49 |
| 3,858,719 | 1/1975 | Isaacs | 206/805 X |
| 4,264,011 | 4/1981 | Dalbo et al. | 206/574 |
| 4,319,703 | 3/1982 | Gann | 206/574 X |
| 4,421,231 | 12/1983 | McCarn | 206/388 |
| 4,664,302 | 5/1987 | Dalbo et al. | 206/574 X |
| 4,782,954 | 11/1988 | Reynolds | 206/574 |

*Primary Examiner*—Paul T. Sewell
*Assistant Examiner*—Jacob K. Ackun, Jr.
*Attorney, Agent, or Firm*—Vinson & Elkins

[57] ABSTRACT

An apparatus as disclosed for holding and organizing colored threads used in needlework. The organizer includes a card, on each face of which are provided a plurality of rings for attaching needlework threads of individual colors and a needle for use with each different color of thread. A plastic sleeve for the card has holes for insertion of the sleeve and card in a three-ring binder.

8 Claims, 1 Drawing Sheet

NEEDLEWORK THREAD ORGANIZER

BACKGROUND AND SUMMARY

The present invention relates to an apparatus for holding and organizing colored threads used for needlework. When performing needlework such as needlepoint, petit point, gross point, cross-stitching and the like, a variety of different colored threads are used to reproduce on a canvas backing a colored design. It is not uncommon for a pattern to require dozens of different colors, and sometimes different textures, of thread or yarn. However, there is presently no satisfactory apparatus available for arranging and organizing all of the different threads used in performing a typical needlework project.

It is accordingly the primary object of the present invention to provide an apparatus for organizing the large number of different threads used in performing a typical needlework project.

Another object is to provide such an apparatus which, when one needlework project is completed, may be re-used for organizing the different threads required for a subsequent needlework project.

A still further object is to provide such an apparatus in which the large number of threads needed for a typical needlework project are kept neatly arranged, and yet visible and readily accessible as they are needed.

These and other objects and advantages of the invention will be apparent from the following description and disclosure of the preferred embodiment of the invention and from the accompanying drawing in which like numerals indicate like parts and in which:

DETAILED DESCRIPTION

Figure 1:
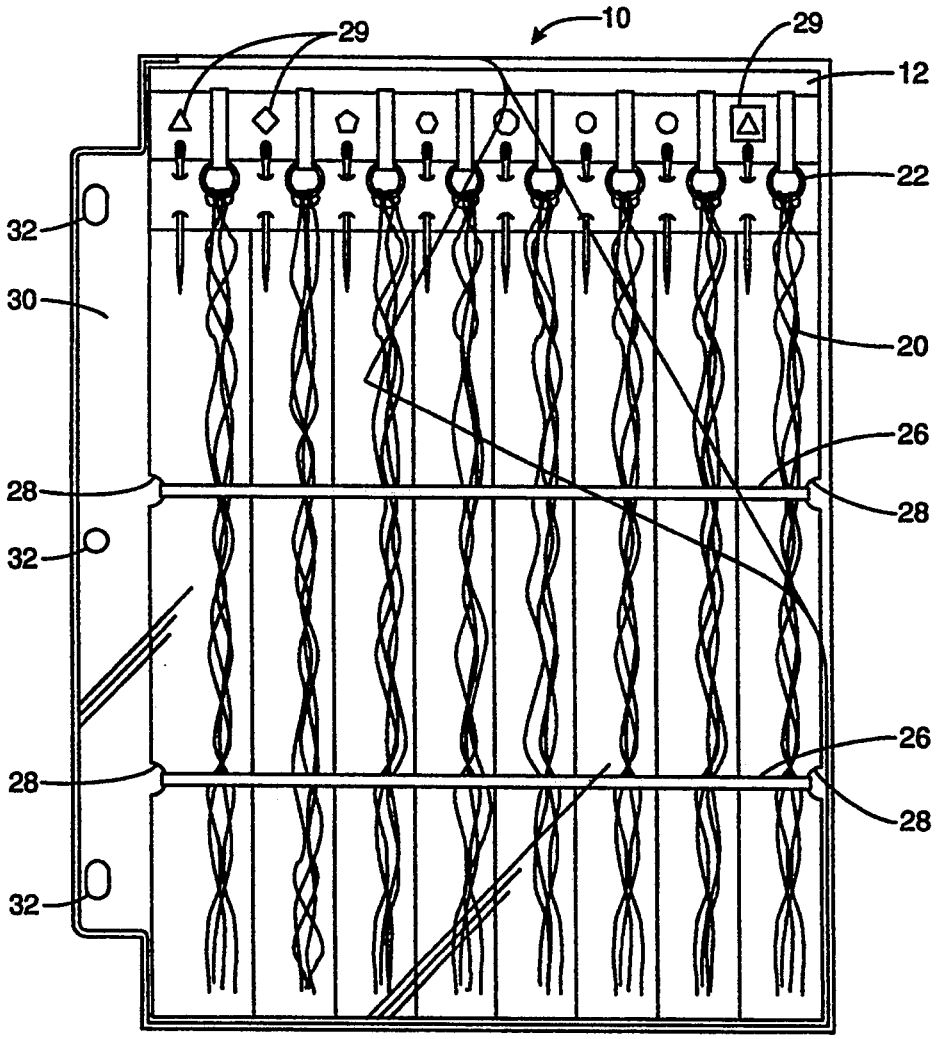
FIG. 1 is a front view in elevation of the preferred embodiment of the needlework organizer in accordance with the present invention.

Referring now to FIG. 1, there is shown the thread organizer 10 in accordance with the present invention. The organizer 10 comprises a thin, rectangular rigid or semi-rigid body or card 12 formed of a suitable material such as cardboard. Indicia such as longitudinal lines 13 may be used to divide the face of the card 12 into a plurality of elongated sections equal in number to the number of different threads to be displayed on the card. Attached to the card 12 along its upper portion are a plurality of spaced thread attachment means, with each thread attachment means being adapted to releasably attach to the card a plurality of needlework threads of an individual color. In the embodiment illustrated, the thread attachment means comprise a plurality of metal rings 14 which are suspended, by a corresponding number of ribbons 16, from the upper edge of a narrow rectangular strip 18. The rectangular strip 18 is formed of a suitable material such as heavy paper or plastic. The two ends of each ribbon 16 extend over the top and behind the strip 18 where they are held in place by a suitable means such as gluing. The entire rectangular strip 18 may then be glued or otherwise fastened onto the face of the card 12, so that the thread attachment rings 14 are held securely in place but may be lifted outward from the face of the body 12 for attachment of the individual needlework threads 20 and for subsequent removal of the threads for use. The needlework threads 20 are attached to the rings by a suitable means such as looping the bundle of threads through the ring, as indicated at 22, so that they are held securely in place, but individual threads may be removed as needed.

Also provided on the organizer body or card 12 are means for releasably attaching a plurality of needles. In performing the needlework project, once a thread of a particular color is threaded through a needle and used in performing a portion of the needlework project, there may be a portion of the thread remaining, so that it is desirable that the needle be returned to the needlework organizer, with any remaining thread still attached, immediately adjacent to the remaining threads of the same color for future use. In the preferred embodiment illustrated, the means for attaching a plurality of needles to the threadwork organizer body comprises a strip 22 of some suitable material, such as cloth or foam, so that a plurality of needles 24, corresponding in number to the number of thread rings 14, may be releasably held in place.

The plurality of individual threads 20 suspended from the plurality of rings 14 is further held in place by means of a plurality of resilient members such as rubber bands 26 adapted to be received around the organizer body 12 and the threads 20 attached thereto. The rubber bands 26 engage retaining notches 28 provided in opposed edges of the body or card 12.

Figure 2:
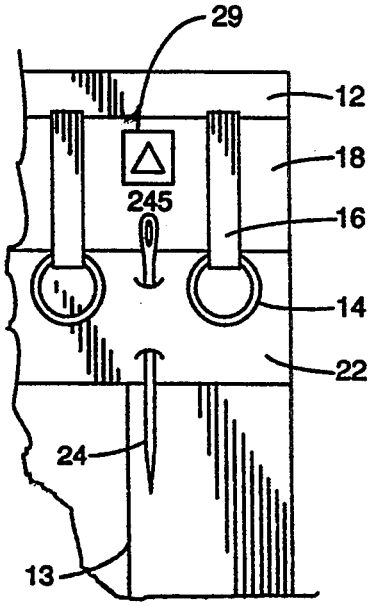
FIG. 2 is an enlarged detail of the upper fight-hand corner of the organizer of FIG. 1.

In performing needlework of many types, the pattern to be followed is reproduced separately on a piece of paper, often in a scale larger than the needlework object being worked. The colors, textures, etc., of threads required at different points on the needlework design may be indicated on the pattern by letters, shapes or other indicia which then are coordinated with specific individual colors, textures, etc. of thread by means of a key accompanying the pattern. It therefore is desirable that the thread organizer also comprise means for receiving a plurality of indicia for relating the individual threads held in the organizer to the pattern being worked. In the preferred embodiment, such indicia receiving means are provided by the strip 18 which suspends the individual thread holding rings 14. As shown in FIGS. 1 and 2, a plurality of different indicia 29 may be adhesively attached, drawn or otherwise placed on the strip 18 in corresponding relation to the needle and ring which hold the thread indicated by the indicia. In many needlework patterns, a set of the indicia are provided on removable individual adhesive stickers or tabs so that they may be attached to the containers, spools, skeins, etc., of the respective thread colors. Such stickers can be removed from the pattern and adhesively attached to the strip 18. Once the project is finished, the stickers can be removed when the thread organizer card is used for a later project.

Some needlework patterns also specify a particular number of threads of a standard length which are required for each different color in the pattern. If desired, indicia indicating the number of threads to be placed on each of the rings at the time the needlework project is begun may also be placed on the card (as indicated by the number "245" in FIG. 2) in corresponding relation to the specific threads indicated.

Although only one side of the card or body 12 has been described, it will be appreciated that both sides preferably are identical, so as to maximize the number of different colors of thread which can be placed on each card.

Figure 3:
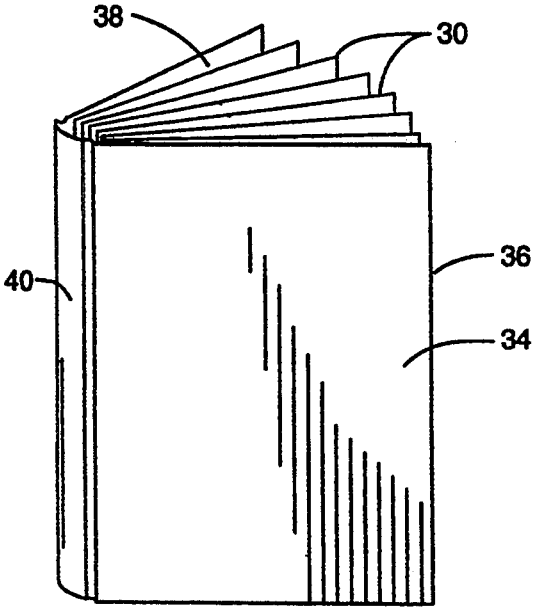
FIG. 3 is an illustration in perspective, of a typical three-ring binder holding a plurality of the thread organizers of FIG. 1.

There also is provided for use with the card 12 a clear plastic sleeve 30 for releasably receiving the card with the threads thereon. The sleeve 30 has a plurality of openings 32 along one edge adapted to cooperate with the snap tings of a conventional 3-ring binder, so that the sleeve, with the card 12 therein, may be retained in a ring binder 34 such as that illustrated in FIG. 3. The ring binder 34 comprises front and back covers 36, 38 and a spine 40. A plurality of snap rings (not shown) releasably retain in the binder a plurality of sleeves 30, each containing a thread card 12. Preferably, the first sleeve 30 will display, instead of a thread card, a key or index for the threads retained in the binder. Such a key might, for example, cross-reference each of the thread indicia 29 to the card number on which that particular thread is contained.

The foregoing disclosure and description of the invention and of the preferred embodiment is illustrative only, and various changes may be made in the size, shape and materials of the construction, within the scope of the appended claims, without departing from the spirit of the invention.

What is claimed is:

1. An apparatus for organizing needlework threads, said apparatus comprising:

a flat, generally rectilinear body;

a plurality of elongated, flexible thread attachment means on said body, each said thread attachment means having one end attached to said body and having at its other end means adapted for releasably attaching a plurality of needlework threads of an individual color;

means on said body for releasably attaching a plurality of needles to said body, said needle attachment means providing means for releasably attaching an individual needle to said body in proximity to each said thread attachment means; and a transparent sleeve for releasably receiving said body.

2. The apparatus according to claim 1 comprising additionally an indicia receiving area on said body adapted for receiving an indicia in proximity to each said thread attachment means for indicating the specific thread to be releasably attached to each individual thread retaining means.

3. The apparatus according to claim 1 wherein said means for releasably attaching said threads comprise a plurality of thread receiving rings attached to the upper portion of said body and a plurality of resilient members adapted to be received around said body, whereby threads attached to said rings may be retained in close proximity to said body.

4. The apparatus according to claim 1 wherein said sleeve has a plurality of openings along one edge thereof adapted to cooperate with the rings of a ring binder, whereby said sleeve, with said body therein, may be received in a ring binder.

5. An apparatus for organizing needlework threads, said apparatus comprising:

a ring binder;

a plurality of transparent sleeves adapted to be releasably engaged in said ring binder;

a plurality of cards, one card being releasably received in each said sleeve, each said card having a plurality of elongated, flexible thread receiving means attached to the upper portion thereof, each said thread receiving means having the upper end attached to said card and having at its lower end means adapted to releasably attach a plurality of needlework threads of an individual color, and a needle attachment means on said card for releasably attaching a plurality of needles to said card, said needle attachment means permitting an individual needle to be attached to said card in proximity to each said thread attachment means.

6. A device for organizing needlework threads, comprising:

a body having indicia dividing said body into a plurality of elongated sections, each said section being adapted to receive a plurality of needlework threads of an individual color;

means associated with each said section for releasably attaching a plurality of individual threads to said body;

means associated with each said section for releasably attaching a needle to said body; and a transparent sleeve for releasably receiving said body.

7. The apparatus according to claim 6 comprising additionally an indicia receiving area associated with each said section for receiving indicia indicating the specific thread to be attached to said body in said section.

8. The device according to claim 6 wherein said means for releasably attaching said threads comprise a ring attached to said body in the upper portion of each said section from which ring a plurality of threads may be suspended and a plurality of resilient members adapted to be received around said body with said threads attached thereto, whereby threads suspended from said rings may be retained in close proximity to said body.

* * * * *